US005783117A

United States Patent [19]

Byassee et al.

[11] Patent Number: 5,783,117

[45] Date of Patent: Jul. 21, 1998

[54] EVAPORATIVE HUMIDIFIER

[75] Inventors: Joe D. Byassee, Bartlett; Scott P. Bojko, Germantown, both of Tenn.

[73] Assignee: Hunter Fan Company, Memphis, Tenn.

[21] Appl. No.: 780,850

[22] Filed: Jan. 9, 1997

[51] Int. Cl.[6] ..... B01D 47/00

[52] U.S. Cl. ..... 261/29; 261/72.1; 261/107; 261/DIG. 46

[58] Field of Search ..... 261/72.1, 29, DIG. 46, 261/104, 107

[56] References Cited

U.S. PATENT DOCUMENTS

| | | | |
|---|---|---|---|
| Re. 35,153 | 2/1996 | Chiu | 261/26 |
| D. 362,906 | 10/1995 | Chiu et al. | D23/356 |
| 3,497,453 | 2/1970 | Yurdin | 261/DIG. 46 |
| 3,610,589 | 10/1971 | Paulin | 261/30 |
| 3,738,621 | 6/1973 | Anderson | 261/72.1 |
| 4,276,241 | 6/1981 | Stewart et al. | 261/92 |
| 4,400,185 | 8/1983 | Goettl | 261/29 |
| 4,466,422 | 8/1984 | Lahiri | 126/350 B |
| 4,499,031 | 2/1985 | Sexton et al. | 261/66 |
| 4,631,297 | 12/1986 | Battice et al. | 521/78 |
| 4,701,286 | 10/1987 | Stillman et al. | 261/36.1 |
| 4,708,832 | 11/1987 | Norback | 261/153 |
| 4,805,793 | 2/1989 | Brandt et al. | 215/10 |
| 4,822,533 | 4/1989 | Steiner et al. | 261/72.1 |
| 4,865,775 | 9/1989 | Steiner et al. | 261/24 |
| 5,037,583 | 8/1991 | Hand | 261/26 |
| 5,061,405 | 10/1991 | Stanek et al. | 261/72.1 |
| 5,086,494 | 2/1992 | Wang | 392/405 |
| 5,110,511 | 5/1992 | Hand | 261/104 |
| 5,133,904 | 7/1992 | Pepper | 261/24 |
| 5,247,604 | 9/1993 | Chiu | 392/406 |
| 5,374,381 | 12/1994 | Schuld et al. | 261/106 |
| 5,460,718 | 10/1995 | Weck et al. | 261/DIG. 46 |
| 5,480,588 | 1/1996 | Tomasiak et al. | 261/72.1 |
| 5,483,616 | 1/1996 | Chiu et al. | 392/406 |
| 5,490,957 | 2/1996 | Lasko et al. | 261/29 |
| 5,529,726 | 6/1996 | Glenn | 261/107 |
| 5,547,615 | 8/1996 | Jane et al. | 261/DIG. 46 |

FOREIGN PATENT DOCUMENTS

| | | | |
|---|---|---|---|
| 2357746 | 5/1975 | German Dem. Rep. | 261/DIG. 46 |
| 8200083 | 9/1982 | Netherlands | 261/29 |

*Primary Examiner*—C. Scott Bushey
*Attorney, Agent, or Firm*—Baker, Donelson, Bearman & Caldwell

[57] ABSTRACT

An evaporative humidifier includes a top cover and a water reservoir tank removably mounted on top of a base platform. Several of the components of the humidifier contain a biocide for resisting the growth of bacteria and fungi on all surfaces of the components. The humidifier includes, in one embodiment, a pump assembly for moving water from the base platform to the top of an evaporator panel disposed in an air stream drawn through the humidifier. Alternatively, a paper wick is partially submerged in the pool of water in the base platform for drawing water up into the air stream by capillary action.

47 Claims, 10 Drawing Sheets

EVAPORATIVE HUMIDIFIER

FIELD OF THE INVENTION

The present invention relates generally to humidifiers, and more particularly, to an evaporative humidifier having components which contain biocides to resist the growth of bacteria and fungi.

BACKGROUND OF THE INVENTION

During the winter months, many different types of known heating systems dry the air in a home. This often results in the inhabitants of the home developing one or more problems including dry skin, scratchy throats and long term coughs. In addition, the contents of the home may lose moisture which may cause furniture to creak, floors to squeak and a build-up of static electricity.

Proper introduction of indoor humidification may alleviate many of the problems associated with an air drying heating system and provide for a more comfortable "feel" and thereby, better living conditions. Various attempts have been made, through different humidification systems, to reintroduce moisture into the air within a dry air home. While known humidification systems are effective for increasing the water content of the atmosphere within a home, they are subject to other problems. For instance known humidifiers may prove to be a breeding ground for bacteria, fungi, mites, and other assorted microbes, due to the presence of standing water within the humidifier.

One known humidification system, comprising a portable humidifier, is disclosed in U.S. Pat. No. 5,490,957, issued to Lasko, et al., herein expressly incorporated by reference in its entirety. The humidifier includes an upper housing and a lower housing which occupies approximately half of the overall height of the humidifier. The lower housing is filled with water to be transmitted to the airflow stream. A motor-driven water pump is submerged in the pool of water within the lower housing, and is used to supply water to a filter disposed within the upper housing. The filter has an expanded aluminum/paper honeycomb construction. The motor also drives a fan which draws an airflow through the filter. The motor is coupled to the pump via a bottom output shaft, and to the fan via a top output shaft. Upon rotation of the pump, water is forced through a pump outlet and upward into a delivery hose, having two outlets. The first hose outlet supplies water to a trough disposed above the honeycomb construction filter. The second hose outlet conveys the remaining water in the hose to a water show nozzle.

Water conveyed to the water show nozzle is splashed onto a water show lens. The water show lens is viewable from outside the humidifier to indicate that a water supply source remains in the bottom housing portion. The absence of a visible indication of water being conveyed to the lens notifies the operator that the bottom housing portion must be re-filled with water. The water that is initially siphoned off from the water delivery hose collects in the water trough and then passes through openings in the trough onto the honeycomb construction filter.

The rotation of the fan causes air to be drawn through a grill in the upper housing portion and across the filter, so as to introduce water into the induced airstream. After passing through the fan blades, the humidifier discharges the air through an exhaust grill in the upper housing portion to introduce humidity into a surrounding space.

While the disclosed humidifier provides a visual indication of water flow and a motor-driven pump to transport water to the filter, it is subject to the following disadvantages. The capacity of the pump supplying water to the filter and to the water show lens is much greater than the capacity required of an otherwise equivalent humidifier eliminating the water show lens and the corresponding supply of water. This increased water capacity, in combination with the fact that the bottom housing portion is the only water reservoir may result in a relatively deep pool of water in the bottom housing portion which may be a breeding ground for bacteria and fungi. An unhealthy and unsightly "slime" may accumulate on the inner surface of the bottom housing portion which is exposed to the pool of water. The relatively deep pool of water has the further disadvantage that the available space for the air inlet grill is compromised, since the air inlet grill may not extend below the water level. The size of the air inlet grill is further limited by the presence of the water show lens. This in turn has an adverse impact on the size and/or surface area utilization of the included filter. A majority of the water in this humidifier passes through the conveyance hose to the water show lens. When water is propelled against the lens, the water splashes on many different interior surfaces of the humidifier. Even small quantities of water on these surfaces may provide a medium for the growth of bacteria and fungi in the absence of biocides or antimicrobial agents. Subsequent disruption of the bacteria may introduce the bacteria directly into the air stream or into the water supply of the humidifier and subsequent conveyance to the filter. The bacteria would then be introduced into the household air stream during evaporation of water from the filter.

U.S. Pat. No. 5,110,571 issued to Hand, discloses a humidifier having a lower frame member which includes a plurality of localized pockets or recesses disposed on the upper side of the lower frame member, with the pockets housing a timed-release biocide. The localized biocide does not provide anti-bacterial or anti-fungal protection throughout the lower frame member or for other components of the humidifier which are exposed to water, either during operation or during shutdown periods when the lower frame member and other components will be damp or moist for varying periods of time. Furthermore, the included biocide is depleted after a single season and therefore requires operator maintenance for replenishment.

A problem uncovered by the use of known humidifiers is the introduction of bacteria, fungi, pathogens and other problem-causing microbes into the air stream, even in the presence of localized submerged pockets of biocide. For example, bacteria or fungi growing on any of the interior surfaces of the humidifier may become dislodged during the normal operation of the humidifier and introduced into the air stream and the surrounding environment due to the forced air currents passing through the humidifier.

In view of the foregoing disadvantages associated with known evaporative humidifiers, there is a need for a "healthy" evaporative humidifier which ensures against the growth and transmission of bacteria, mold and spores, in a moisture-laden airstream.

SUMMARY OF THE INVENTION

The present invention achieves these and other goals by providing an evaporative humidifier which protects against the growth and transmission of bacteria and fungi into a humidified airstream. An evaporative humidifier according to the present invention includes a base platform formed from a material containing a biocide for resisting growth of bacteria and fungi on the base platform, a top cover removably mounted on the base platform, and a water reservoir tank removably mounted on the base platform for releasing water into the base platform to a predetermined depth. The humidifier further includes an evaporator panel assembly for holding water received from the base platform, with the panel assembly including a frame mounted on the base platform and an evaporator panel disposed within the frame. A fan assembly is included for drawing air into the humidifier across the evaporator panel assembly and for forcing air out of the humidifier.

As used herein, the term "evaporator panel" refers to a paper, cardboard, expanded plastic, or expanded metal structure used to distribute water across a large surface area so as to facilitate the evaporation of water in a forced airstream. Accordingly, while the term "evaporator panel" is used throughout the specification, it is intended to encompass the use of paper "wicks" as well as cardboard, plastic or metal "evaporator panels". The preferred evaporator panel comprises a plurality of layers of expanded metal, with each layer preferably coated with a clay-based covering incorporating or containing a biocide.

The base platform contains a first biocide, or antimicrobial agent, preferably VINYZENE, for the purpose of resisting growth of bacteria and fungi on the base platform. To further enhance the provision of a "healthy" humidifier, the frame of the evaporator panel assembly also contains the first biocide, again preferably VINYZENE, and the clay-based coating which covers the layer of expanded metal of the evaporator panel includes a second biocide, preferably zinc, OMADINE, for resisting the growth of bacteria and fungi on the corresponding components of the evaporator panel assembly.

The humidifier may include a pump assembly and associated conduits for transporting water from the base platform to a diffuser tray forming an upper portion of the evaporator panel assembly frame and disposed above the evaporator panel. As yet another aspect of the "healthy" evaporative humidifier of the present invention, portions of the pump assembly and the associated water transport conduits also incorporate a biocide, preferably VINYZENE, for resisting the growth of bacteria and fungi within the humidifier.

The diffuser tray includes a plurality of rows of holes disposed in a bottom plate thereof which are effective for supplying water to the evaporator at a predetermined flow rate. The water flow rate preferably ranges from about 15 gallons per hour to about 25 gallons per hour.

The humidifier further include a motor assembly, which is rotatably coupled to both the fan and pump assemblies. Upon energizing the electric motor of the motor assembly, the fan and pump impeller of the corresponding assemblies rotate, causing water to be supplied to the diffuser tray above the evaporator panel and air to be drawn through the evaporator panel.

A means for maintaining a predetermined depth of water in the base platform is disposed within a cap of the reservoir tank. The means for maintaining is preferably a spring-biased water release valve. The combination of the removably mounted water tank and the spring-biased water release valve which periodically dispenses water from the tank into the base platform, allows the depth of water within the base platform to be minimized which further inhibits the growth of bacteria and fungi within the humidifier. This feature also permits maximum utilization of the surface area of the evaporator panel, with respect to exposure to airflow, since a lowermost portion of an air inlet disposed in the top cover may be positioned closer to the base platform without being submersed in water, relative to a humidifier having an increased water depth.

BRIEF DESCRIPTION OF THE DRAWINGS

These and other features, aspects, and advantages of the present invention will become better understood with regard to the following description, appended claims and accompanying drawings wherein:

DETAILED DESCRIPTION OF THE PREFERRED EMBODIMENTS

Figure 1:
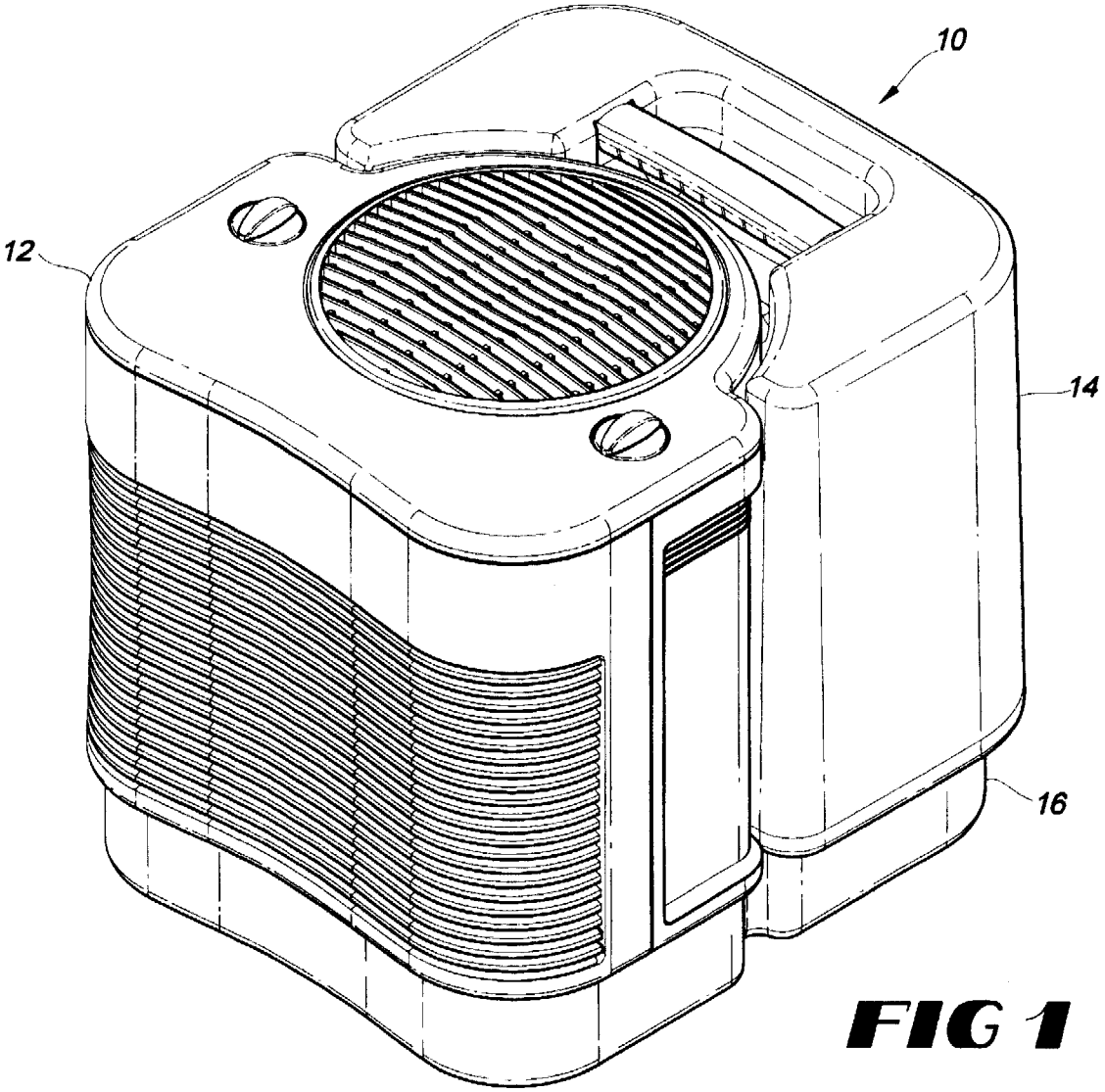
FIG. 1 is a perspective view of an evaporative humidifier incorporating the principles of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
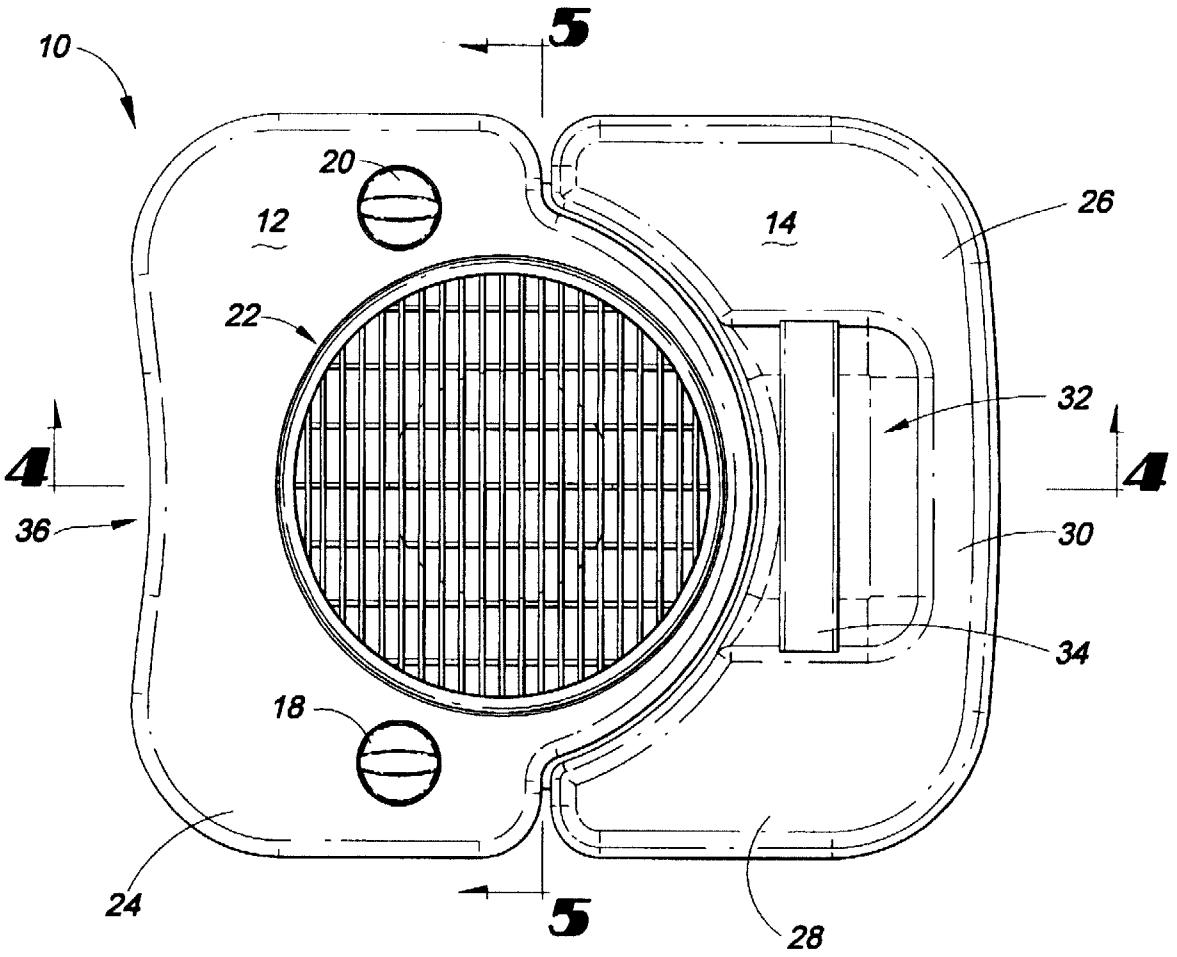
FIG. 2 is a top plan view of an evaporative humidifier incorporating the principles of the present invention and illustrating an air outlet grill located in a top cover portion positioned adjacent to a water reservoir tank.
Figure 3:
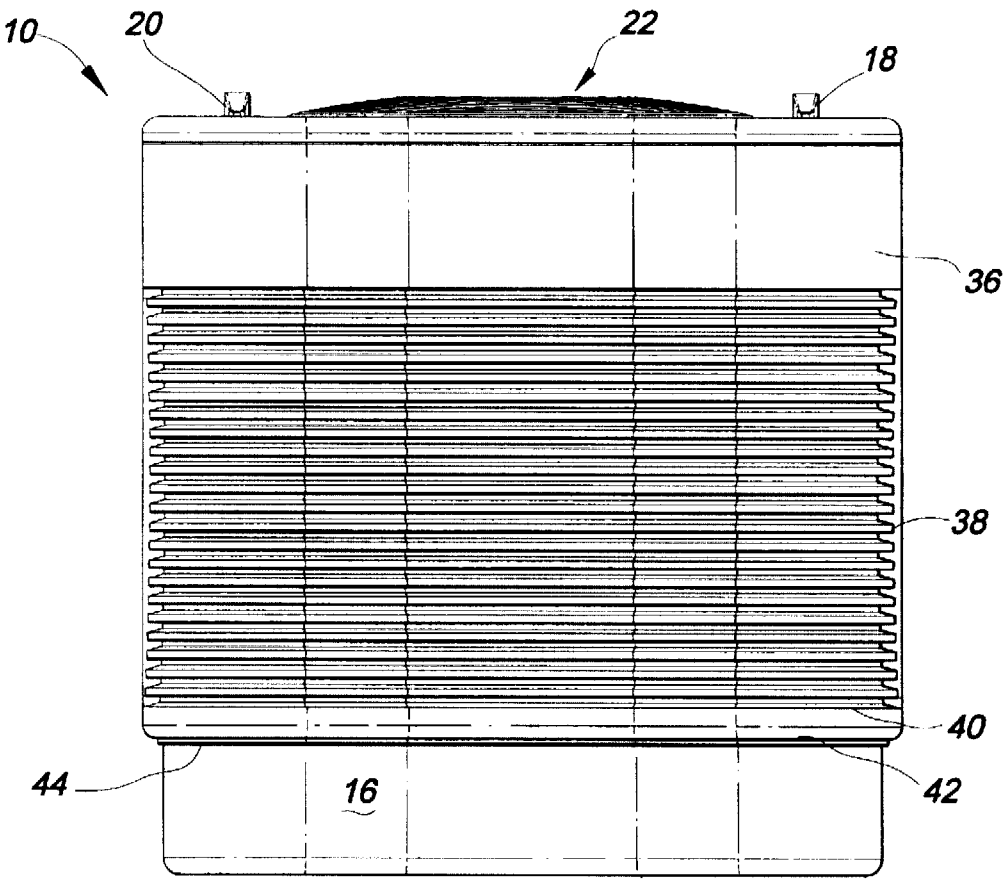
FIG. 3 is a side elevation view of the evaporative humidifier illustrating an air inlet grill located in a side of the top cover which is removably mounted on the base platform.

With reference to the drawings, in general, and to FIGS. 1 through 7, 9, and 10 in particular, an evaporative type humidifier embodying the teachings of the subject invention is generally designated as 10. As used herein the term "evaporative humidifier" refers to a humidifier which evaporates water into a forced airstream by drawing a flow of air through a water retaining element disposed within the humidifier. As shown in FIGS. 1–3, the humidifier includes a top cover 12, a water reservoir tank 14 and a base platform 16. The top cover 12 and the reservoir tank 14 are removably mounted on the base platform 16.

The base platform 16 is made of molded plastic, which may be formed by either injection molding or blow molding. Base platform 16 is formed from a material, preferably plastic, which contains a biocide or antimicrobial agent for the purpose of resisting or retarding the growth of bacteria and fungi throughout all surfaces of base platform 16, including the inner surface 17 of base platform 16 which contacts water as subsequently discussed in greater detail.

The biocide is incorporated into a polymeric resin prior to the molding process. The biocide-containing polymeric resin is then molded into the desired shape of base platform 16. As a result of this process the biocide is substantially uniformly distributed throughout the plastic used to construct base platform 16.

The substantially uniform distribution of the biocide throughout the plastic used to construct base platform 16 provides anti-bacterial and anti-fungal protection throughout base platform 16, as opposed to localized areas for instance, and provides this protection in a maintenance-free manner throughout the service life of humidifier 10. The base platform is preferably made of injection or blow molded polypropylene. However, base platform 16 may be formed from any plastic or other material which is compatible with biocide incorporation. The biocide may comprise 10, 10'-oxybisphenox-arsine, available under the tradename VINYZENE from Morton International; zinc pyrithione, available from Olin Corporation, under the tradename zinc OMADINE; 2,4,4-trichloro-2'-hydroxydiphenyl ether, available from Microban Co., under the tradename MICROBAN Additive B, and also available from Ciba-Geigy Corporation, under the tradename IRGASAN DP 300; or other antimicrobial agents which are physically and chemically compatible with the polymer or plastic material of construction of the base platform 16. VINYZENE is preferred due to manufacturing cost considerations and to the somewhat enhanced effectiveness of VINYZENE in resisting the growth of certain microorganisms. The substantially uniform distribution of a biocide or antimicrobial agent throughout base platform 16, as well as a similar distribution of biocides throughout other components of humidifier 10 (and the coating of a subsequently discussed evaporator panel with a biocide) is a significant feature of the present invention.

Top cover 12 includes two electrical switches 18 and 20. The switches 18 and 20 control the speed of the fan located inside of the top cover 12 and the humidity of the air forced through air outlet grill 22 located in the upper surface 24 of the top cover, respectively.

Reservoir tank 14 includes leg portions 26 and 28, and a cross piece 30 interconnecting leg portions 26 and 28. Leg portions 26 and 28, and cross piece 30 are configured so as to form an overall U-shape of reservoir tank 14, and a recess 32 which is spanned by a handle 34. The operator of humidifier 10 may lift and carry tank 14 in an inverted position by grasping the handle 34. The tank 14 may also include a second handle 35 (shown in FIGS. 9 and 10) disposed about the top portion of the tank which provides a means for carrying tank 14 in an upright position. The use of the two handles 34 and 35 facilitate filling tank 14 with water. A foot 37 is integrally formed with the handle 35 and is attached to a top portion of tank 14. Foot 37 may be used to support tank 14 in an inverted position (in conjunction with a subsequently discussed cap 180 of tank 14) after removing tank 14 from base platform 16. The curvature of the leg portions 26, 28 and cross piece 30 follow the contour of the top cover 12 and the semicircular projection formed by the air outlet grill 22 which extends along the height of the top cover 12.

Humidifier 10 further includes an air inlet grill 38, which is disposed in a sidewall 36 of the top cover 12. Grill 38 allows passage of air into the interior of the top cover 12. In the illustrated embodiment shown in FIG. 3, a lowermost edge portion 40 of the air inlet grill 38 is located slightly above the lowermost visible edge 42 of the top cover 12 which is seated on an uppermost edge 44 of base platform 16. The top cover 12 extends into the base platform 16 to provide a secure removable fit of the top cover 12 on the base platform 16.

Figure 4:
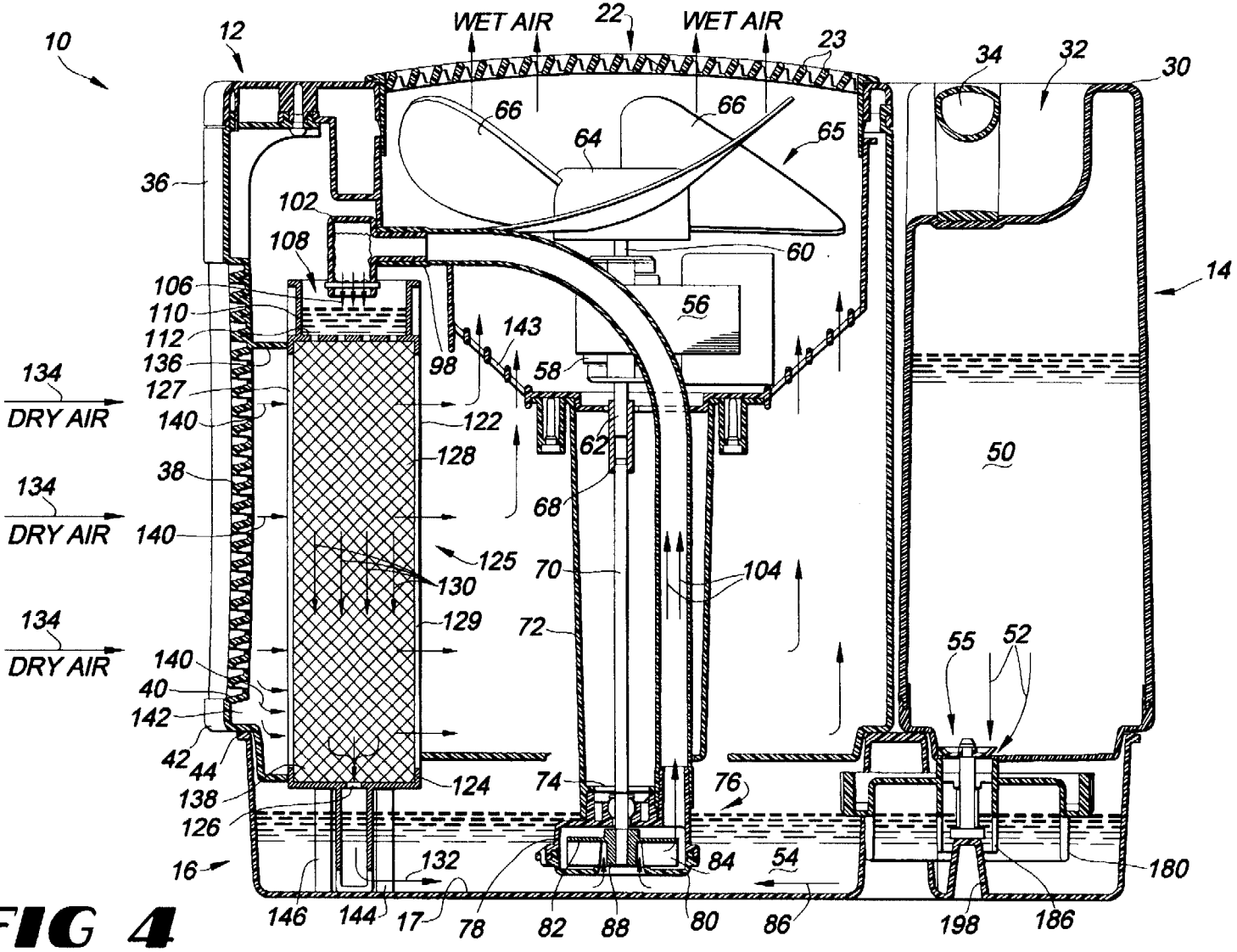
FIG. 4 is a cross-sectional view of the humidifier, taken along line 4—4 in FIG. 2.
Figure 5:
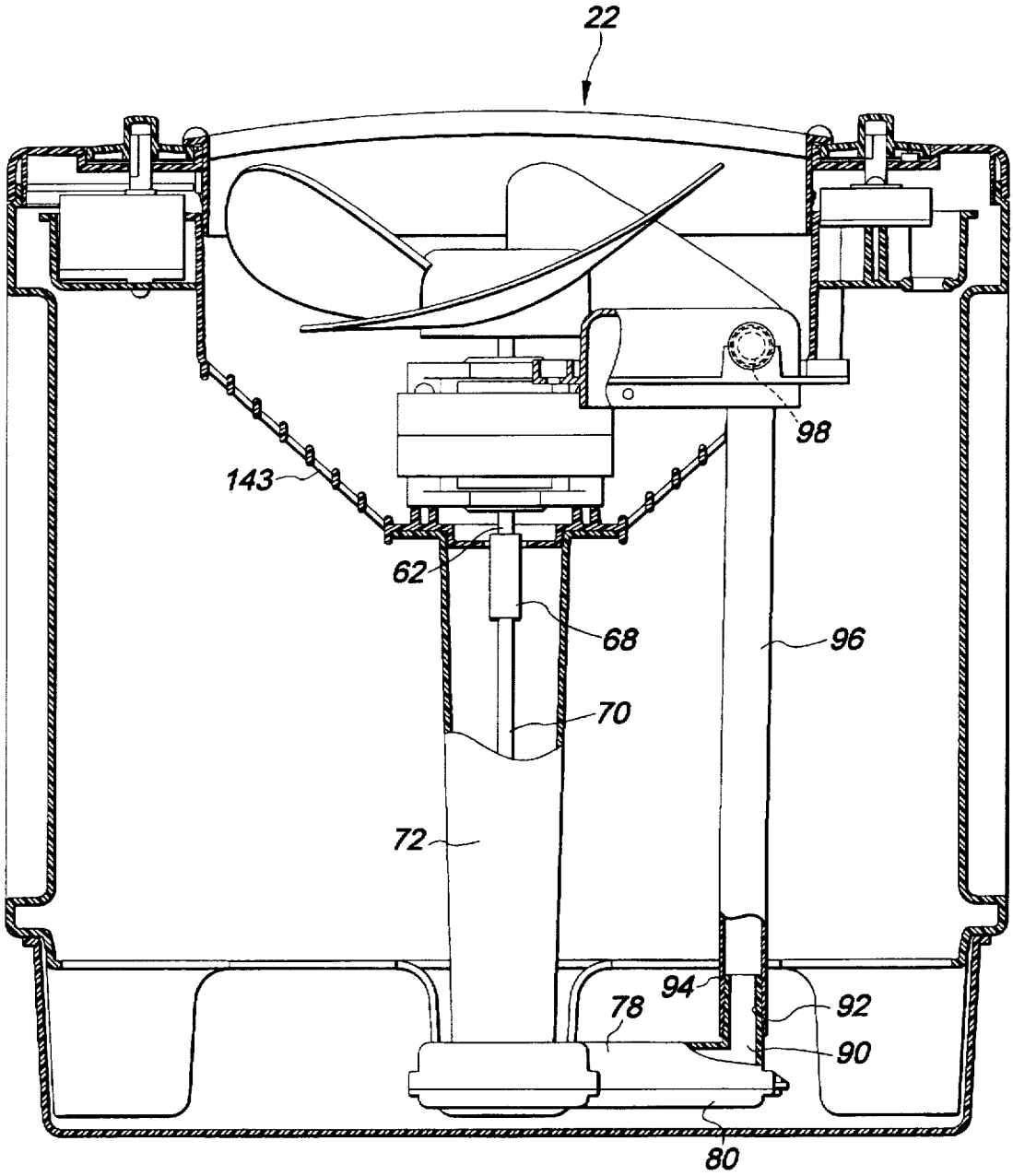
FIG. 5 is a cross-sectional view of the humidifier, taken along line 5—5 in FIG. 2.
Figure 6:
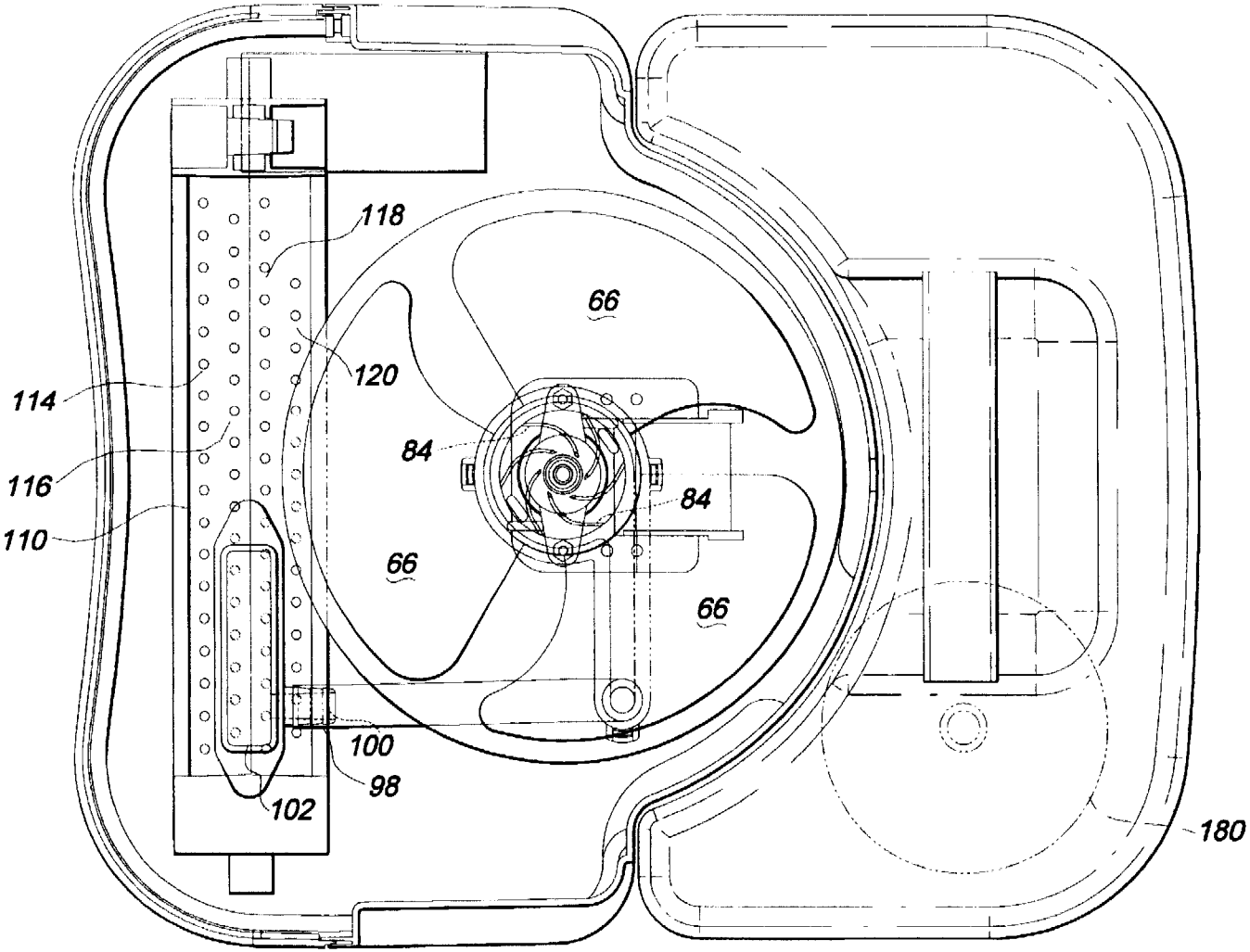
FIG. 6 is a top plan view of the humidifier with the uppermost portion of the top cover of the humidifier removed for purposes of illustration to view the internal components of the humidifier.

With reference to FIG. 4, the internal components of the humidifier are shown. Initially, a water supply 50 contained in tank reservoir 14 is conveyed along the path indicated by arrows 52 into the bottom of the base platform 16 to form a pool of water 54 to a predetermined depth ranging from about 1 inch to about 1–½inches. The tank reservoir 14 includes a means for maintaining the predetermined depth of the water pool 54, which comprises a spring-biased water release valve 55. The details of the operation of valve 55, which controls the release of water 50 to the base platform 16, will be explained in more detail with reference to FIG. 7. The use of the tank reservoir 14, which is removably mounted on base platform 16, in combination with the periodic dispensing of water from tank 14 to base platform 16 through the spring-biased water release valve 55 allows the predetermined depth of the water pool 54 to be substantially less than the depth of standing water within conventional humidifiers utilizing a tub or base portion of the humidifier as the only water reservoir (ie, without the equivalent of tank 14 and valve 55). In such conventional devices, the water depth may be significantly greater (on the order of several inches) if the humidifier is filled to a depth accommodating a full day's supply of water for instance. The reduced depth of the water pool 54 relative to that of comparably sized conventional humidifiers (in output capacity), significantly reduces the likelihood that bacteria or fungi will grow in the water pool 54 relative to the water reservoirs of conventional humidifiers. Additionally, the reduced depth of water pool 54 permits the lowermost edge portion 40 of the air inlet grill 38 to be positioned lower without being submersed in water. This in turn allows the overall height of an evaporator panel 128, subsequently discussed in greater detail, to be increased for a given overall height of humidifier 10 or alternatively permits a more effective utilization of the surface area of the panel 128 with respect to exposure to airflow through grill 38, depending upon the relative vertical positioning of the grill 38 and panel 128. In either event the frontal surface area of the evaporator panel 128 which is exposed to air flow discharging from grill 38 may be greater than that of the foregoing conventional humidifier having a comparable size. Consequently, the performance of humidifier 10 is better than that of conventional humidifiers. It should be understood that increasing the height of the top cover 12 to accommodate a taller evaporator panel while maintaining the same output of humidifier 10, measured in pounds of water per day, is undesirable due to the increased manufacturing costs associated with such an increase in the size of cover 12.

As shown in FIG. 4, humidifier 10 further includes a motor assembly 56 comprising a motor 58 which has oppositely directed output shafts 60 and 62. A distal end of shaft 60 is rotatably coupled with a hub 64 of a fan assembly 65. The fan assembly 65 further includes a plurality of radially extending fan blades 66 which are mounted on the hub 64. The pitch and radial height of blades 66, as well as the number of blades 66, were optimized for airflow output and noise level to produce an efficient and quiet fan assembly 65. The oppositely extending output shaft 62 is connected by a coupling 68 to a pump drive shaft 70. The coupling 68 and drive shaft 70 are housed within a hollow column 72.

The pump shaft 70 extends through a base plate 74 of the column 72 and into a pump assembly 76 having housing parts 78 and 80. The pump assembly 76 includes a submersible centrifugal pump having an impeller 82 located inside the housing portions 78 and 80. Impeller 82 includes a plurality of radially extending vanes 84.

As shown by directional line 86, upon energization of motor 58 and rotation of the impeller 82, water from the pool of water 54 in communication with inlet 88 is forced tangentially outward to an outlet 90 including a hollow projection 92. Coupled to the projection 92 is one end 94 of an outlet conduit 96. The opposite end 98 of the conduit 96 engages a friction fit conduit or pipe 100 having an elongated downspout opening 102. Accordingly, water is conveyed from the pool of water 54 along the path indicated by direction arrows 104. The elongated opening 102 allows water to fall in the direction of arrows 106 into a diffuser tray 108.

Elongated opening 102 releases water by gravity between the sidewalls 110 of diffuser tray 108. A bottom plate 112 of the diffuser tray includes a plurality of rows 114, 116, 118 and 120 of holes for timed release of the water into a frame 122. A top plate of the frame 122 is formed by the bottom plate 112 of the diffuser tray 108. The frame 122 also includes a lower plate 124 having a centrally located elongated opening 126. The opposed sides of the frame are sealed to the top and bottom plates of the frame with the only additional openings of the frame being formed in front panel 127 and rear panel 129 to permit the flow of air therethrough.

Housed in the frame 122 is an evaporator panel 128. The frame 122 and evaporator panel 128 combine to form an evaporator panel assembly 125. In the most preferred embodiment shown in FIG. 4, the evaporator panel 128 is formed of a plurality of layers of slit and expanded metal, preferably aluminum, having a fired clay-based covering or coating incorporating or containing a biocide. Adjacent layers of the expanded metal, which are bonded to one another, are offset relative to one another to produce a tortuous flowpath for the air passing through panel 128. The clay-based covering creates a hydrophilic coating which enhances the ability of the evaporator panels to retain water. The biocide or antimicrobial agent which is incorporated in the clay-based coating is preferably zinc OMADINE. However, other biocides may be used which are compatible with the formulation of the clay-based covering.

The incorporation of the biocide in panel 128 resists the growth of bacteria or fungi on panel 128 and is therefore an integral part of the overall objective of providing a "healthy" humidifier. Additionally, the use of expanded metal to construct panel 128 permits panel 128 to be periodically removed and cleaned if desired in a conventional dish washer for instance.

Panel 128 may alternatively be constructed of a plurality of slit and expanded layers of plastic, preferably polypropylene, which incorporates a biocide during the fabrication of the polypropylene panel. In this embodiment the biocide is preferably VINYZENE but may comprise the alternative antimicrobial agents listed previously with respect to the base platform 16 of humidifier 10.

As further alternatives, a cardboard evaporator panel or paper "wick" may be used in lieu of panel 128. An example of a cardboard evaporator panel which may be used is available under the tradename Polar Pad from Research Products Corporation. The cardboard evaporator panel and paper wick preferably include a biocide or antimicrobial agent.

A plurality of fingers 144, 146 retain the frame 122 in position on the base platform 16. The frame 122 is removable for replacing or cleaning the evaporator panel 128 housed in frame 122 after a predetermined period of use. This mounting arrangement for frame 122 also facilitates the use of varying sizes for frame 122 and panel 128.

Water passing through the openings in the rows 114, 116, 118 and 120 of the diffuser tray 108, passes through the evaporator panel 128 in the direction of arrows 130. The flow rate of the water delivered to the evaporator panel 128 is determined by the size and number of holes in rows 114, 116, 118 and 120, which may be optimized for a given application. A preferred range of water flow rate into panel 128 is about 15 gallons per hour to about 25 gallons per hour. Water that passes to the bottom of the evaporator panel 128 exits the frame 122 through the opening 126 and is returned into the pool of water 54 for movement in the direction of arrow 132, back to the inlet 88 of the pump assembly 76. Water is thereby continuously recycled within humidifier 10. Depletion of the pool of water 54 is periodically made up by water 50 from the reservoir tank 14.

In order to further resist the growth of bacteria and fungi within humidifier 10, the following components of humidifier 10 are made of a molded material, preferably polypropylene, and incorporate or contain a biocide or antimicrobial agent uniformly distributed throughout as a result of the same process discussed previously with respect to base platform 16: housing parts 78 and 80 of pump assembly 76; pump impeller 82; hollow column 72; outlet conduit 96; pipe 100; and frame 122. Any plastic or other material which is compatible with biocide incorporation may also be used to form these components of humidifier 10. The preferred biocide for these components is VINYZENE but may comprise the alternative biocides discussed previously with respect to base platform 16. As with platform 16, the preferred concentration of the biocide ranges from about 0.6% to about 2% by weight, with the most preferred concentration being about 1% by weight.

In operation, humidifier 10 functions to humidify the air in the environment surrounding humidifier 10. This is effectuated by supplying water to base platform 16 via tank reservoir 14 and valve 55 and energizing motor 58 which produces simultaneous rotation of the impeller 82 of pump assembly 76 and the blades 66 of assembly fan 65. Rotation of the impeller 82 results in water being delivered to the top of evaporator panel 128, with the water then flowing downward through panel 128 as discussed previously. A preferred range of airflow through humidifier 10 is 90 to 165 scfm (standard cubic feet per minute) which corresponds to an output of 2 to 5 gallons of water per day. The fan speed control switch 18 regulates the speed of fan assembly 65 between an off, low and high speed position. The humidistat, or switch 20 allows the operator to control the humidity level. Upon reaching a predetermined percentage of humidity, current to the motor 58 is interrupted until the humidity in the surrounding environment falls below the predetermined humidity set point. A preferred range of humidity is about 30% to about 40%.

Upon rotation of the fan blades 66, air is drawn in the direction of arrows 134 in a "dry" condition into air inlet grill 38. It is understood that the "dry" air will typically include some level of relative humidity and that humidifier 10 serves to further humidify this air. A baffle plate 136 defines an upper boundary of the flowpath for the air entering humidifier 10 through grill 38.

The air passing below baffle plate 136 moves through the opening in the front panel 124 of the frame 122 to pass through the tortuous flowpath of the evaporator panel 128, which may vary with the material of the evaporator panel.

Since the lowermost edge 40 of the inlet grill 38 is located above the lowermost portion 138 of the evaporator panel 128 in the illustrative embodiment shown in FIG. 4, a portion of the air discharging from grill 38 will follow a somewhat downward path (as illustrated by the lower ones of flow arrows 140) so as to fill the space 142 between edge 40 of grill 38 and portion 138 of panel 128. As discussed previously, control of the depth of water pool 54 to the predetermined depth ranging from about 1 inch to about 1.5 inches maximizes the utilization of the frontal surface area of panel 128 with respect to exposure to incoming air, thereby enhancing the performance of humidifier 10.

The air passing through the evaporator panel 128 causes water located in the evaporator panel 128 to be evaporated and introduced into the air stream. This humidified air is then continuously drawn out of the evaporator panel 128 and passed through a conically shaped grill 143 to exit the top cover through the outlet grill 22. Humidity is thereby introduced into the environment surrounding humidifier 10. Grill 22 includes a plurality of spaced slats or struts 23 which may have a variable orientation relative to vertical to direct the air discharging from grill 22 away from the inhabitants of the environment surrounding humidifier 10 if desired.

Figure 8:
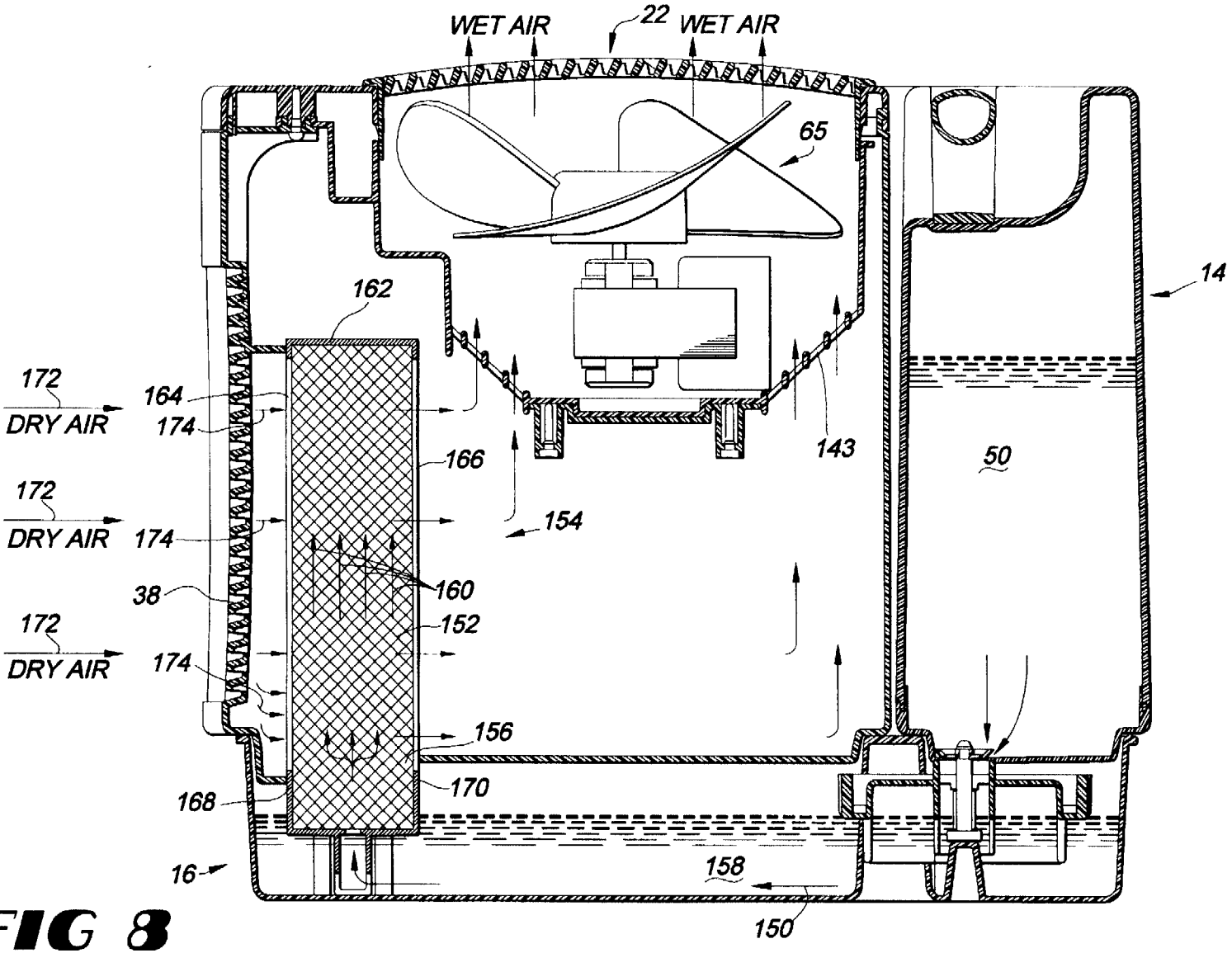
FIG. 8 is a cross-sectional view of an alternative embodiment of the present invention illustrating the use of an evaporator panel assembly drawing water from the base platform by capillary action.
Figure 9:
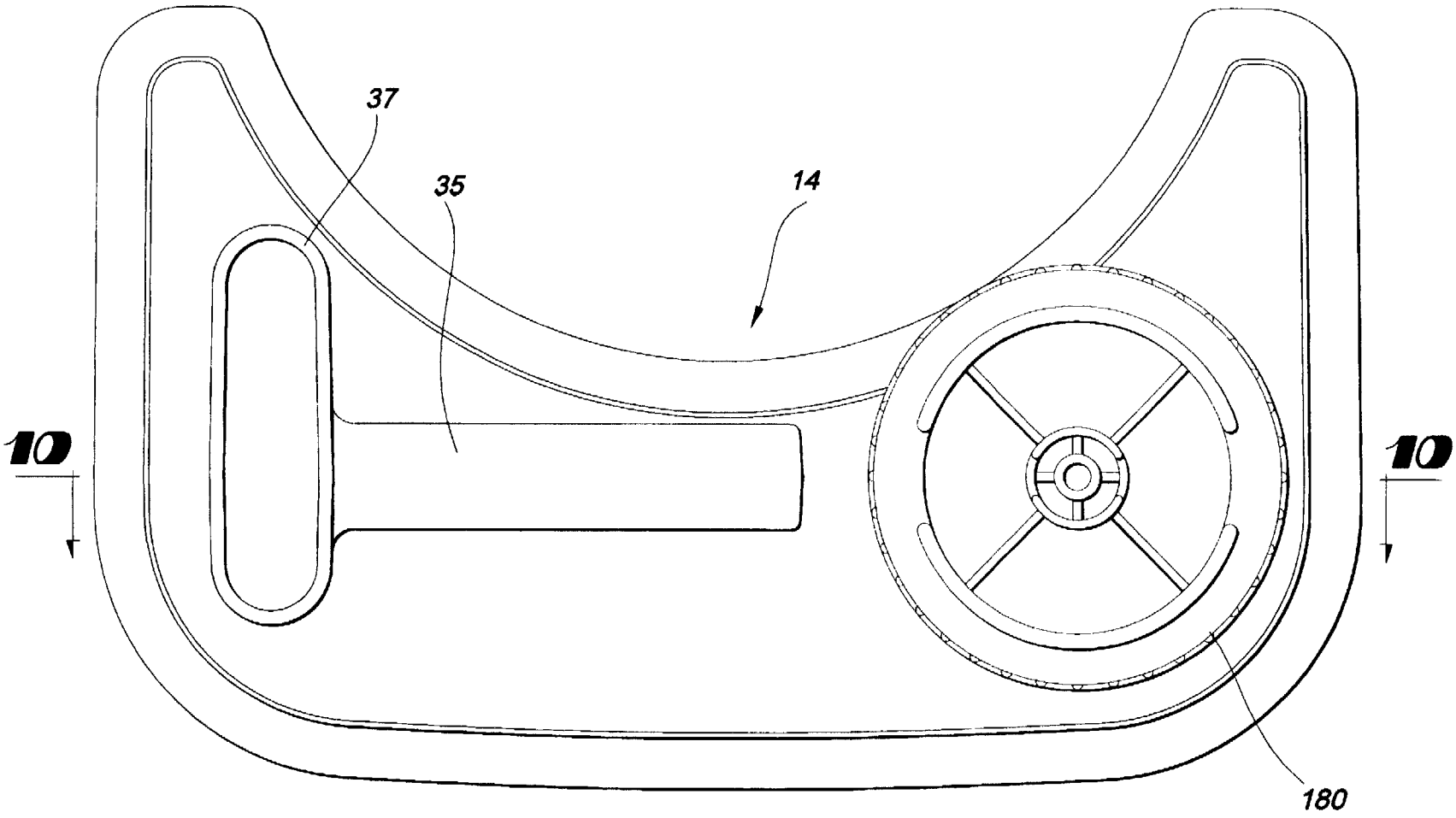
FIG. 9 is a bottom plan view of the evaporative humidifier shown in FIGS. 1–7.
Figure 10:
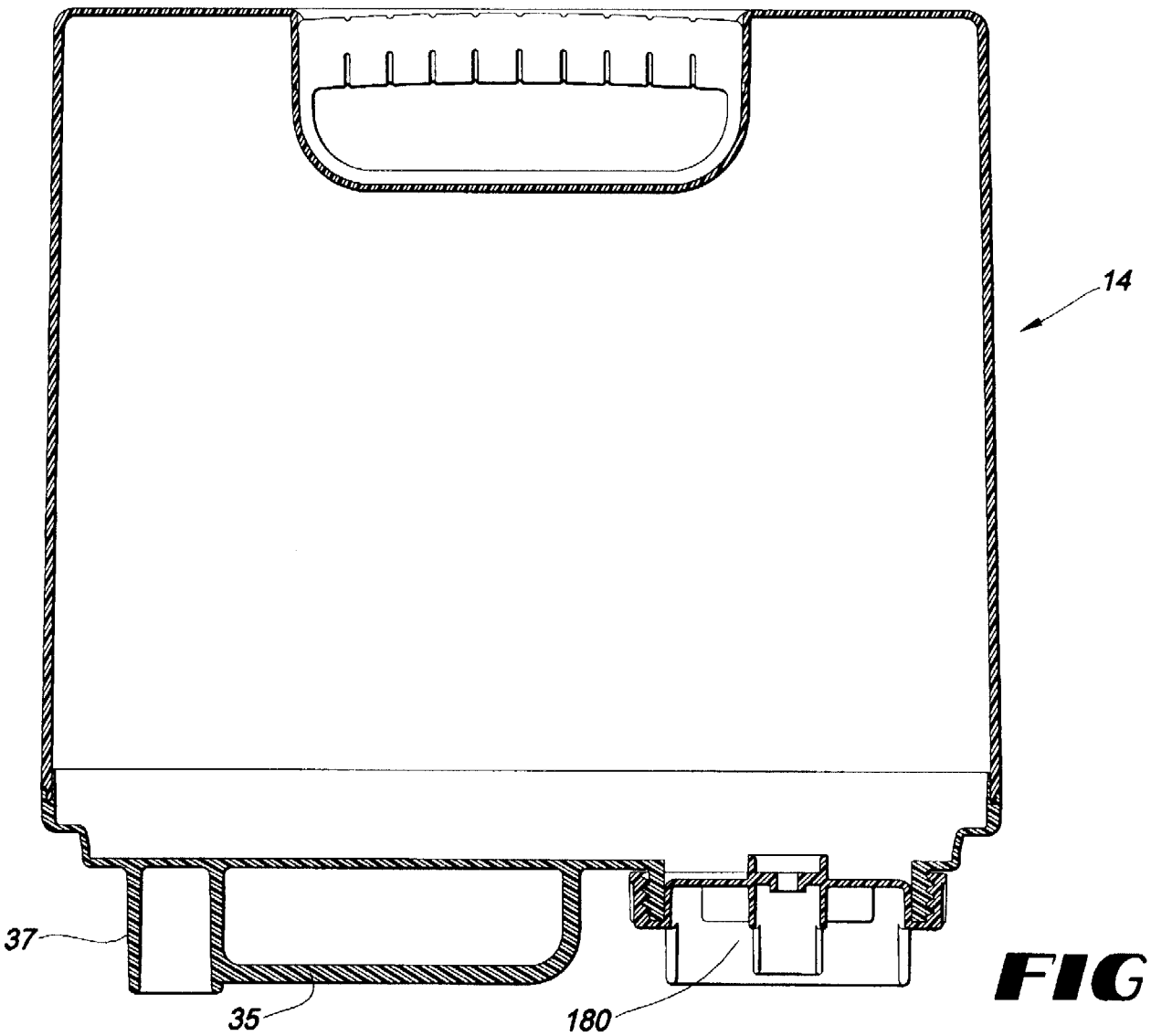
FIG. 10 is a side elevation view taken along line 10—10 in FIG. 9.

In an alternate embodiment of the present invention, as shown in FIG. 8, source of water 50 in reservoir tank 14 is introduced into the base platform 16 in a direction of directional line 150. In this embodiment, an evaporator panel 152 is housed in a frame 154. Panel 152 is a "wick"-type water retaining element constructed of paper. A lowermost portion 156 of the water retaining element 152 is positioned to extend into a pool of water 158 formed in the base platform 16.

By capillary action, water moves up into the water retaining element 152 in the direction of arrow lines 160. In this embodiment, a non-perforated top plate 162 of the frame 152 is sealed with the sides of the frame 152 and includes openings in the front panel 164 and rear panel 166. However, in the bottom panel 168 openings 170 are provided to allow free flow of water up into the water retaining element 152. Since water is transferred to the water retaining element 152 by capillary action, the pump assembly 76 of the prior embodiment and the associated water transfer conduits are eliminated.

As with the prior embodiment, operation of the fan assembly 65 causes "dry" air 172 to be drawn through inlet grill 38 and into water retaining element 152 as shown by flow arrows 174. The humidified air discharging element 152 then passes through grills 143 and 22 into the surrounding environment. Frame 154 is preferably made of a molded plastic having a biocide uniformly distributed throughout as discussed previously with respect to frame 122 of the prior embodiment. The structure and function of the embodiment illustrated in FIG. 8 is otherwise the same as that discussed with respect to the embodiment of FIGS. 1–7, 9, and 10.

Figure 7:
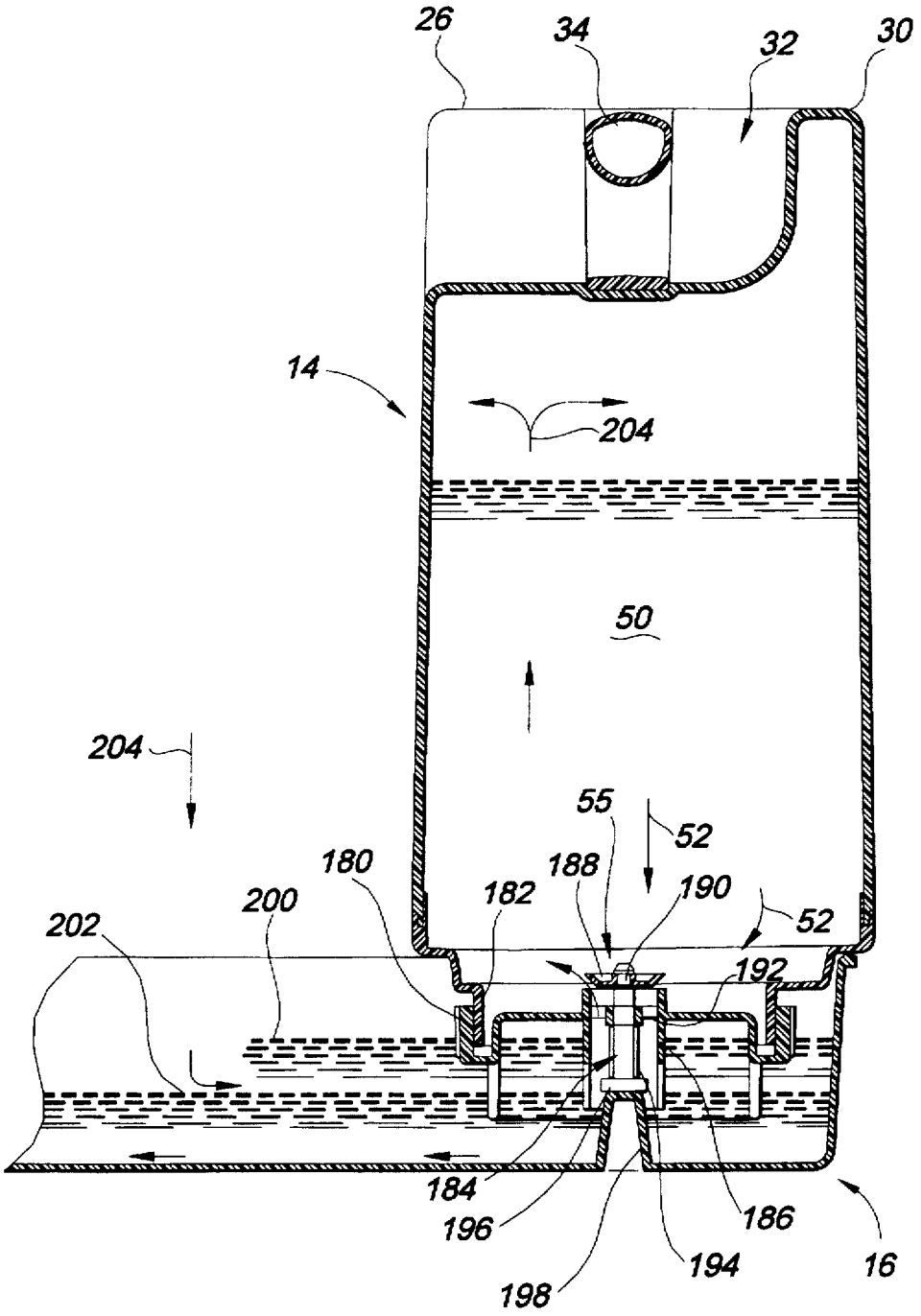
FIG. 7 is a detailed view of the water tank reservoir and its operation for release of water into the base platform.

In FIG. 7, the details of the supply of water 50 to the base platform 16 are shown. The tank 14 is shown in an inverted position, as compared to a filling position. To fill the tank 14, the cap 180 is unscrewed from an opening defined by a sidewall 182. Water is poured into the opening until the tank 14 is full. The cap 180 is then secured back onto the tank 14, thereby sealing tank 14, and the tank 14 is inverted. The size of the water reservoir tank 14 may be varied to accommodate different sized volumes to be humidified. For example, a 2.0, 2.5, 3.0, 3.5, 4.0 or 5.0 gallon tank may be used to humidify corresponding living spaces or volumes having standard 8 foot high ceilings and living areas of approximately 1100, 1300, 1500, 1600, 1800, and 2000 square feet, respectively.

Tank 14 is preferably made of a lightweight, durable material such as a plastic, or any other material suitable for holding water. The material of construction of tank 14 preferably incorporates or contains a biocide to resist the growth of bacteria and fungi. Since it is desirable to view the contents of tank 14 to determine the water level therein, tank 14 may be constructed of a transparent material such as a plastic in the styrene family. Tank 14 remains sealed except during the periodic release of water to base platform 16 via valve 55. This feature assists in resisting or retarding the growth of bacteria and fungi within tank 14 since the water within tank 14 is not subjected to continuous contamination from airborne microorganisms.

The spring-biased water release valve 55, which is effective for maintaining or controlling the predetermined depth of the water pool 54 in base platform 16, is mounted in a cylindrical portion 186 defined in the cap 180. Valve 55 includes a reciprocal plunger 184 mounted in the cylindrical portion 186 and a tapered flange 188 which is mounted at one end of a shaft 190. Shaft 190 is retained by sleeve 192 which is fixed to the cap 180. A spring 194 is schematically shown surrounding the shaft 190 and having one end abutting the sleeve 192 and the opposite end abutting a plate 196 located at the opposite end of shaft 190 from the flange 188.

When tank reservoir 14 is mounted on the base platform 16, the plate 196 engages a projection 198 extending upwardly from the bottom of the base platform 16. As a result of plate 196 contacting the projection 198, flange 188 is unseated from cylindrical portion 186. Water is thereby allowed to flow in the direction of arrow 52 out of the tank 14 and into the base platform 16.

When the water reaches a depth indicated by line 200, the introduction of air into the tank 14 is prevented by the water level sealing access into the interior of the tank 14 through openings included in cylindrical portion 186. As water is depleted from the base platform 16, either by pumping upwardly to an evaporator panel or being drawn upwardly by capillary action, the water level in the base platform 16 will fall to a level approximated by line 202. At this level, air is allowed to flow up into the tank reservoir in the direction of arrow line 204. The air in the tank 14 will force water down out of the tank 14 past the unseated flange 188 until the water reaches the level approximated by line 200 to prevent further air from being introduced into the tank 14.

When all the water 50 is removed from the reservoir tank 14, the tank 14 may be lifted by handle 34. An indication that the water supply has been depleted may be provided by an optional float mechanism (not shown) within base platform 16 which may trigger an indicator such as a light (not shown) for instance. This mechanism may also interrupt the electricity provided to motor 58. Upon removal of tank 14, plate 196 does not contact the projection 198, and spring 194 biases flange 188 to seat against cylindrical portion 186, thereby sealing the tank 14. This is important because when the tank 14 is again filled with water and inverted prior to placement on the base platform 16, it is necessary that the water in the tank 14 be sealed in place by flange 188.

Although the illustrative embodiments of the present invention have been shown to include a single reservoir tank 14, it is contemplated as being within the scope of the present invention to utilize a plurality of vertically stacked tanks 14 within humidifier 10. The use of multiple tanks 14 may provide increased water capacity and/or distribute the total water weight among the tanks 14, thereby facilitating the transport of each individual tank 14.

As a further alternative, a tap line from a water pipe may be disposed in fluid communication with a single tank 14 or an upper one of a plurality of tanks 14. Release of water from the tap line may then be controlled by a float valve, for example, to only allow passage of water to the corresponding tank 14 due to a reduction of the water level within the tank 14.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. An evaporative humidifier comprising:

a base platform, said base platform being formed from a material which contains a first biocide for resisting growth of bacteria and fungi on said base platform, a top cover removably mounted on said base platform, a water reservoir tank removably mounted on said base platform for releasing water into said base platform to a predetermined depth, an evaporator panel assembly for holding water received from said base platform, said evaporator panel assembly including a frame mounted on said base platform and an evaporator panel disposed within said frame, a fan assembly for drawing air into the humidifier across said evaporator panel assembly and for forcing air out of the humidifier.

2. An evaporative humidifier as claimed in claim 1, wherein said evaporator panel comprises a plurality of layers of expanded metal.

3. An evaporative humidifier as claimed in claim 2, wherein said each of said layers of expanded metal includes a clay-based covering.

4. An evaporative humidifier as claimed in claim 3, wherein said clay-based covering contains a second biocide for resisting the growth of bacteria and fungi.

5. An evaporative humidifier as claimed in claim 1, wherein said evaporator panel is a paper wick.

6. An evaporative humidifier as claimed in claim 1, wherein said evaporator panel is made of a cardboard.

7. An evaporative humidifier as claimed in claim 1, further comprising a submersible pump for moving water from said base platform to said evaporator panel.

8. An evaporative humidifier as claimed in claim 7, wherein water is pumped by said pump to a diffuser tray located above said evaporator panel assembly.

9. An evaporative humidifier as claimed in claim 8, wherein said diffuser tray includes a plurality of rows of holes for release of water down into said evaporator panel.

10. An evaporative humidifier as claimed in claim 9, wherein said diffuser tray forms an upper portion of said frame.

11. An evaporative humidifier as claimed in claim 1, wherein a lowermost portion of said evaporator panel is disposed above a level of water in said base platform.

12. An evaporative humidifier as claimed in claim 1, wherein a lowermost portion of said evaporator panel extends below a level of water in said base platform.

13. An evaporative humidifier as claimed in claim 1, wherein said evaporator panel comprises a plurality of layers of expanded plastic.

14. An evaporative humidifier as claimed in claim 1, wherein a concentration of said first biocide ranges from about 0.6% to about 2% by weight.

15. An evaporative humidifier as claimed in claim 14, wherein said first biocide comprises VINYZENE.

16. An evaporative humidifier as claimed in claim 4, wherein said second biocide comprises zinc OMADINE.

17. An evaporative humidifier as claimed in claim 1, wherein water is released to said base platform at a flow rate ranging from about 15 gallons per hour to about 25 gallons per hour.

18. An evaporative humidifier as claimed in claim 1, further comprising:

a means for maintaining said predetermined depth of water in said base platform, said means for maintaining comprising a spring-biased water release valve.

19. An evaporative humidifier as claimed in claim 7, further comprising:

a motor assembly rotatably coupled with said pump and said fan assembly.

20. An evaporative humidifier comprising:

a housing having an air stream drawn in through an air inlet and passed out of an air outlet, a supply of water to said housing for retention as a pool of water, a water retaining element for placing water in said air stream, said water retaining element being located intermediate of said air inlet and said air outlet, a base platform of said housing for retaining said pool of water, said base platform being made of a material containing a biocide for resisting growth of bacteria and fungi on said base platform.

21. An evaporative humidifier as claimed in claim 20, wherein said supply of water includes a tank reservoir mounted on said base platform.

22. An evaporative humidifier as claimed in claim 20, wherein said water retaining element is a plurality of layers of expanded metal held in a frame.

23. An evaporative humidifier as claimed in claim 22, wherein said frame is made of a material containing said biocide, said biocide being substantially uniformly distributed throughout said frame.

24. An evaporative humidifier as claimed in claim 20, wherein said water retaining element receives water from said pool of water by capillary action.

25. An evaporative humidifier as claimed in claim 20, wherein said water retaining element receives water from said pool of water by a pump assembly and a conduit.

26. An evaporative humidifier as claimed in claim 25, wherein portions of said pump assembly incorporate said biocide.

27. An evaporative humidifier as claimed in claim 22, wherein said plurality of layers of expanded metal include a clay-based coating.

28. An evaporative humidifier as claimed in claim 27, wherein said biocide comprises a first biocide and said clay-based coating contains a second biocide.

29. An evaporative humidifier as claimed in claim 20, wherein said water retaining element is contained in a frame.

30. An evaporative humidifier as claimed in claim 29, wherein said frame is made of a material containing said biocide, said biocide being substantially uniformly distributed throughout said frame.

31. An evaporative humidifier as claimed in claim 25, wherein water is conducted through said conduit to a diffuser tray located above said water retaining element.

32. An evaporative humidifier as claimed in claim 20, wherein a lowermost portion of said water retaining element extends into said pool of water.

33. An evaporative humidifier comprising:

a base platform, a top cover removably mounted on said base platform, a water reservoir tank removably mounted on said base platform for releasing water into said base platform to a predetermined depth, said water reservoir tank being constructed of a material which contains a biocide for resisting the growth of bacteria and fungi, an evaporator panel assembly for holding water received from said base platform, said evaporator panel assembly including a frame mounted on said base platform and an evaporator panel disposed within said frame, a pump assembly including a submersible pump for moving water from said base platform to said evaporator panel assembly, a fan assembly for inducing a flow of air through said evaporator panel and for exhausting the air, having an increased relative humidity, out of said humidifier.

34. An evaporative humidifier comprising:

a base platform.

a top cover removably mounted on said base platform, a water reservoir tank removably mounted on said base platform for releasing water into said base platform to a predetermined depth, an evaporator panel assembly for holding water received from said base platform, said evaporator panel assembly including a frame mounted on said base platform and an evaporator panel disposed within said frame, a pump assembly including a submersible pump for moving water from said base platform to said evaporator panel assembly a fan assembly for inducing a flow of air through said evaporator panel and for exhausting the air, having an increased relative humidity, out of said humidifier, wherein:

said base platform is made of a material containing a first biocide for resisting growth of bacteria and fungi on said base platform.

35. An evaporative humidifier as claimed in claim 34, wherein:

portions of said pump assembly incorporate said first biocide.

36. An evaporative humidifier as claimed in claim 35, wherein:

said frame is made of a material containing said first biocide, said evaporator panel comprises a plurality of layers of expanded metal, said layers of expanded metal are coated with a clay-based covering incorporating a second biocide.

37. An evaporative humidifier as claimed in claim 33, further comprising:

a motor assembly rotatably coupled to said pump assembly and said fan assembly.

38. An evaporative humidifier as claimed in claim 1, wherein:

said water reservoir tank is constructed of a material which contains a second biocide for resisting the growth of bacteria and fungi.

39. An evaporative humidifier as claimed in claim 38, wherein:

said material of construction of said water reservoir tank comprises a plastic.

40. An evaporative humidifier as claimed in claim 21, wherein:

said tank reservoir is constructed of a material which contains a second biocide to resist the growth of bacteria and fungi.

41. An evaporative humidifier as claimed in claim 40, wherein:

said material of construction of said tank reservoir comprises a plastic.

42. An evaporative humidifier as claimed in claim 34, wherein:

said water reservoir tank is constructed of a material which contains a biocide for resisting the growth of bacteria and fungi.

43. An evaporative humidifier as claimed in claim 42, wherein:

said material of construction of said water reservoir tank comprises a plastic.

44. A humidifier comprising:

a housing having a base platform, said base platform being made of a material which contains a biocide for resisting the growth of bacteria and fungi on said base platform;

means for supplying water to said base platform;

a water retaining element for holding water received from said base platform; and a fan assembly for drawing air into the humidifier through said water retaining element and for exhausting the air, having an increased relative humidity, out of said humidifier.

45. A humidifier comprising:

a housing having a base platform;

a water reservoir tank removably mounted on said base platform for releasing water into said base platform to a predetermined depth, said water reservoir tank being constructed of a material which contains a biocide for resisting the growth of bacteria and fungi;

a water retaining element for holding water received from said base platform; and a fan assembly for drawing air into said humidifier through said water retaining element and for exhausting the air, having an increased relative humidity, out of said humidifier.

46. A humidifier comprising:

a housing having a base platform, said base platform being made of a material which contains a biocide for resisting the growth of bacteria and fungi on said base platform;

means for supplying water to said base platform;

humidification means for introducing water from said base platform into the environment surrounding said humidifier.

47. A humidifier comprising:

a housing having a base platform;

a water reservoir tank removably mounted on said base platform for releasing water into said base platform to a predetermined depth, said water reservoir tank being constructed of a material which contains a biocide to resist the growth of bacteria and fungi;

humidification means for introducing water from said base platform into the environment surrounding said humidifier.

* * * * *

US005783117C1

(12) EX PARTE REEXAMINATION CERTIFICATE (5212th)

United States Patent
Byassee et al.

(10) Number: US 5,783,117 C1
(45) Certificate Issued: Oct. 4, 2005

(54) EVAPORATIVE HUMIDIFIER

(75) Inventors: Joe D. Byassee, Bartlett, TN (US); Scott P. Bojko, Germantown, TN (US)

(73) Assignee: Hunter Fan Company, Memphis, TN (US)

Reexamination Request:
No. 90/006,290, May 14, 2002

Reexamination Certificate for:

| | |
|---|---|
| Patent No.: | **5,783,117** |
| Issued: | **Jul. 21, 1998** |
| Appl. No.: | **08/780,850** |
| Filed: | **Jan. 9, 1997** |

(51) Int. Cl.[7] ..... B01D 47/00
(52) U.S. Cl. ..... 261/29; 261/72.1; 261/107; 261/DIG. 46
(58) Field of Search ..... 261/29, 72.1, 104, 261/107, 103, 106, DIG. 46; 424/409, 411, 412; 523/122

(56) References Cited

U.S. PATENT DOCUMENTS

| | | | | |
|---|---|---|---|---|
| 5,169,561 A | * | 12/1992 | Gentle et al. | 523/122 X |
| 5,478,563 A | * | 12/1995 | Erami | 424/409 |
| 5,520,854 A | * | 5/1996 | Porco et al. | 261/72.1 X |
| 5,614,568 A | * | 3/1997 | Mawatari et al. | 523/122 |
| 5,849,319 A | * | 12/1998 | Davies | 424/409 |

FOREIGN PATENT DOCUMENTS

| | | | |
|---|---|---|---|
| JP | S61-33456 | | 9/1986 |
| JP | H01-167544 | | 7/1989 |
| JP | H05-180471 | | 7/1993 |
| JP | H06-088634 | | 3/1994 |
| JP | H06-271726 | | 9/1994 |
| KR | 96-0002968 | * | 3/1996 |

OTHER PUBLICATIONS

*A new approach for better life*, Highly Safe Inorganic Antibacterial Agent, *Bactekiller®(Antibacterial Zeolite)*, The South East Asia Development Co. Ltd., undated.

* cited by examiner

*Primary Examiner*—Richard L. Chiesa

(57) ABSTRACT

An evaporative humidifier includes a top cover and a water reservoir tank removably mounted on top of a base platform. Several of the components of the humidifier contain a biocide for resisting the growth of bacteria and fungi on all surfaces of the components. The humidifier includes, in one embodiment, a pump assembly for moving water from the base platform to the top of an evaporator panel disposed in an air stream drawn through the humidifier. Alternatively, a paper wick is partially submerged in the pool of water in the base platform for drawing water up into the air stream by capillary action.

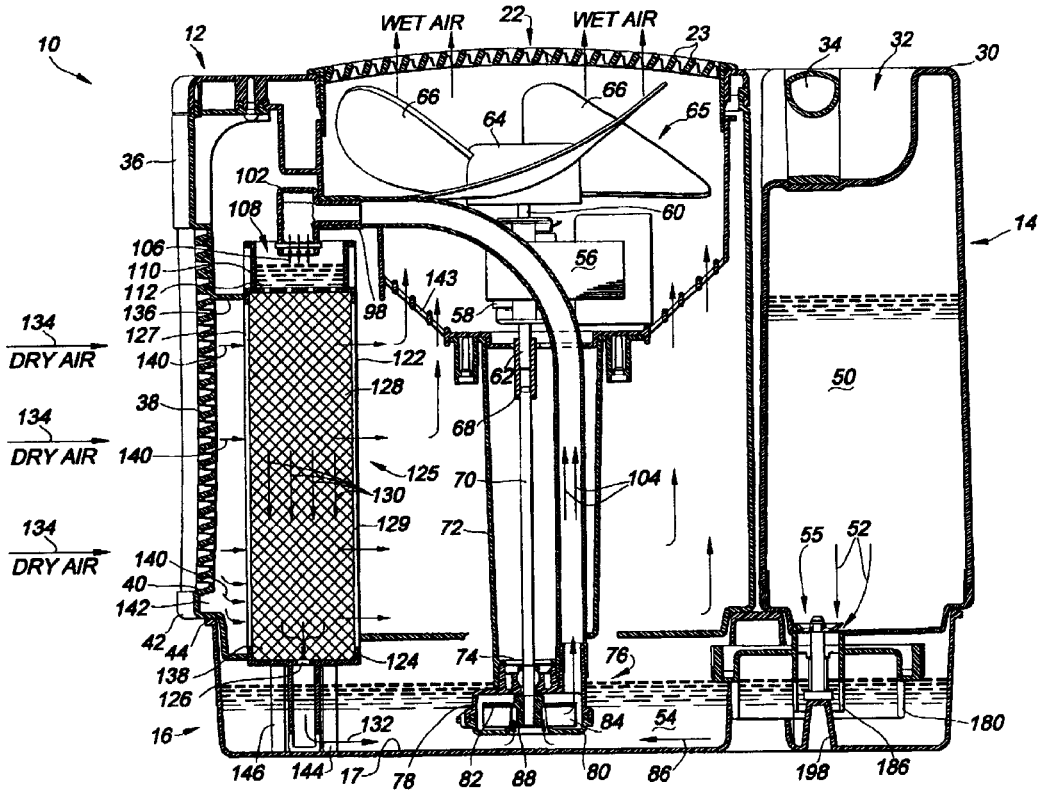

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 36 is confirmed.

Claims 1–35 and 37–47 are cancelled.

* * * * *